US007174832B1

(12) United States Patent
Shann

(10) Patent No.: US 7,174,832 B1
(45) Date of Patent: Feb. 13, 2007

(54) LOGGING OF DETONATOR USAGE

(75) Inventor: Peter Christian Shann, Fulford (GB)

(73) Assignee: SMI Technology (Pty) Ltd., Gauteng (ZA)

( * ) Notice: Subject to any disclaimer, the term of this patent is extended or adjusted under 35 U.S.C. 154(b) by 0 days.

(21) Appl. No.: 09/958,005

(22) PCT Filed: Mar. 29, 2000

(86) PCT No.: PCT/GB00/01085

§ 371 (c)(1),
(2), (4) Date: Nov. 19, 2001

(87) PCT Pub. No.: WO00/60305

PCT Pub. Date: Oct. 12, 2000

(30) Foreign Application Priority Data

Apr. 1, 1999 (GB) ..... 9907547.5

(51) Int. Cl.
*F42B 15/34* (2006.01)

(52) U.S. Cl. ..... 102/293

(58) Field of Classification Search ..... 705/28; 102/293; 361/247–252
See application file for complete search history.

(56) References Cited

U.S. PATENT DOCUMENTS 3,640,222 A * 2/1972 Graham ..... 102/318
4,674,047 A * 6/1987 Tyler et al. ..... 89/28.05
4,714,017 A * 12/1987 Kelly et al. ..... 102/275.3
6,293,204 B1 * 9/2001 Regen ..... 102/430

FOREIGN PATENT DOCUMENTS

| | | |
|---|---|---|
| AU | 578223 | 11/1988 |
| EP | 301848 | 2/1989 |
| GB | 2204162 | 11/1988 |
| WO | WO 96/16311 | 5/1996 |
| WO | WO 97/21067 | 6/1997 |
| WO | WO 97/45696 | 12/1997 |

* cited by examiner

*Primary Examiner*—Andrew Joseph Rudy
(74) *Attorney, Agent, or Firm*—Kirton & McConkie; Evan R. Witt

(57) ABSTRACT

A system for logging authorized detonator usage of identifiable detonators, after removal of the detonators from a controlled store, in which the system includes an inventory control for maintaining an inventory of detonators at the controlled store, and also data concerning authorized removal of detonators from the store for use on site as part of a controlled blasting sequence; and a fire control station which monitors and logs the destruction of each detonator after transmission of a fire signal to each detonator, and transmits detonator destruction data to the inventory control.

22 Claims, 1 Drawing Sheet

LOGGING OF DETONATOR USAGE

BACKGROUND OF THE INVENTION

This invention is concerned with a system for logging authorised detonator usage, with a view to monitoring theft of detonators by terrorist or criminal organisations.

The authorised use of explosives is well known in quarries, and other environments in which the splitting-up and separation of a rock mass is required e.g. in tunnelling, and in the past, the use of explosives and detonators at such sites has not been as secure as it should be, so that criminal and terrorist gangs have regarded such sites as an easy source of detonators and explosives.

However, although security at sites is now much improved, it is still a recognised fact that explosive material, and particularly detonators can still end up in the wrong hands. Furthermore, since explosive mixtures can quite readily be derived from entirely innocent sources e.g. fertilizers (and which cannot easily be controlled), this makes it particularly important to control the storage, and usage of detonators which might be used to detonate "home made" explosive mixtures which tend to be used by some terrorist organisations.

Modern day detonators are becoming increasingly sophisticated in design and operation i.e. so-called electronic detonators, and in an authorised environment, detonators and associated explosive packages are placed at required blast points in a rock mass, and then are fired from a remote control station at predetermined intervals in a fire control programme or sequence with a view to optimise the effectiveness of each blasting sequence.

The detonators and explosive packages will normally be stored on site for future use, and a proper inventory is kept of new supplies, and usage, with a view to controlling authorised usage and hopefully to monitor any unauthorised removal of detonators.

BRIEF SUMMARY OF THE INVENTION

The invention, however, seeks to automate the logging of authorised detonator usage in a way which gives greatly improved control, so as to minimise the risks of unauthorised removal of detonators going unnoticed. The system of the invention may also be used as a valuable production and supply control tool.

The invention is primarily based on the fact that present day detonators have an identification code, and that such a code must first be recognised at a remote control (firing) station, and then a firing signal is transmitted to each detonator at a predetermined time interval in a particular programmed blasting sequence.

Accordingly, in one aspect of the present invention provides a system for logging authorised detonator usage of identifiable detonators, after removal of the detonators from a controlled store, and said system comprising:

means for maintaining an inventory of detonators at the controlled store, and also data concerning authorised removal of detonators from the store for use on site as part of a controlled blasting sequence; and means for monitoring and logging the destruction of each detonator after transmission of a fire signal to each detonator.

The controlled store may be Located on site, and/or at a secure location, and data-input will be made of all supplies of identifiable detonators to the store. Also, data input will be made of all authorised removal of detonators from the store.

Alternatively, the controlled store may be located at the site of manufacture, and data input will be made of detonators going into store, and authorised supply.

Conveniently, the initiation of a fire command signal from a fire control/command station will take place after identification of each detonator e.g. in the case of a coded detonator after logging of the issue of signalling of the code of the detonator and of its ready-to-fire status when sited.

The invention, therefore, enables tight detonator control to be kept over a) the supply to store b) removal from store and c) destruction, so as to minimise the risks of theft and unauthorised removal of detonators going unnoticed.

In the case of a detonator coded at manufacture, complete traceability from manufacture to use is possible.

The invention, therefore, provides for detonator fire security data logging. In particular, it allows the prevention and/or detection of criminal access and use of detonators, by securely logging the event of the actual destruction of each detonator, and by preserving a record of number of detonators destroyed. Preferably, this will be carried out by data storage of serial numbers and time records. Alternatively, in the case of a sequentially wired system, data will be stored as to the destruction of each detonator.

The instant of destruction of each detonator may be securely recorded by logging each detonator signalling its code, and ready-to-fire status to the fire control station. Upon subsequent issue of a fire command signal, in a controlled blasting sequence, an entry can be made in a secure electronic register held in the exploder of the event of the destruction of each detonator.

The reference to "destruction" of a detonator, is intended to be interpreted very generally, and which includes the time frame in which explosion is initiated (sequenced) and thereby effecting substantial preclusion of removal of detonator(s) from shot at the time of destruction in an effort to defeat system security.

During a firing sequence, any unauthorised removal of a detonator from the firing circuit would abort the fire command, resulting in no entry of destruction. Alternatively, if a detonator is removed prior to a firing sequence, a record will be kept only of actual firing of detonators being logged, and thereby allowing recordal of any missing detonators.

To facilitate the maintenance of an inventory of detonators, bar codes may be utilised on the detonators (the same as internally on a chip serial number), and which is logged at the time of issue of the detonators, via preferably a handheld bar code reader. This is then subsequently securely compared electronically with an exploder use log (optionally downloadable and comparable in handheld logger), verifying detonator use.

This, therefore, provides complete traceability from the point of manufacture of detonators and exploders through to completion of authorised usage.

The system of the invention may, therefore, be used effectively to deter secretion of detonators from sites of legitimate use, or by examination of exploder logs can indicate illegitimate use of exploders in firing stolen detonators, and optionally indicating detonator serial number and time of initiation.

In the case of certain existing types of electronic detonators, firing is only possible via specialised computer exploder system, precluding use of conventional power sources to initiate the detonator. The implementation of the system of the invention to such detonators would improve the detection of, and deter attempts to acquire detonators for the purposes of disassembly and re-engineering explosive detonator components, and signal early indication of the events of detonator and computer theft.

The detonators which can be controlled in usage by the system of the invention may be entirely conventional resistive electric detonators, and at the time of firing a secure record of firing circuit resistance (equal to the cumulative value of the resistance of each detonator and firing cable resistance-series circuit) could be logged.

The identification of each detonator can be achieved in a number of ways. In one arrangement, there is provided a means of signalling of each detonator status and/or existence and which is available at the time at which the detonator is required to fire. The means of identification may be by way of individual detonator codes, or by sequential wiring of the circuit, so as to effect verification of each detonator status at the time of firing.

The detonators may also be coded at the factory of manufacture, and data input be made at the factory. The logged usage of authorised detonators on site also can be stored, and later checked by regular audit.

In a further and more general aspect of the invention also provides a system for logging authorised detonator usage, in which means is provided electronically to record detonator destructions.

Preferably, the system further includes means for entering and preserving electronically a record of usage and destruction in a secure (preferably tamperproof) manner.

DETAILED DESCRIPTION OF THE INVENTION

Figure 1:
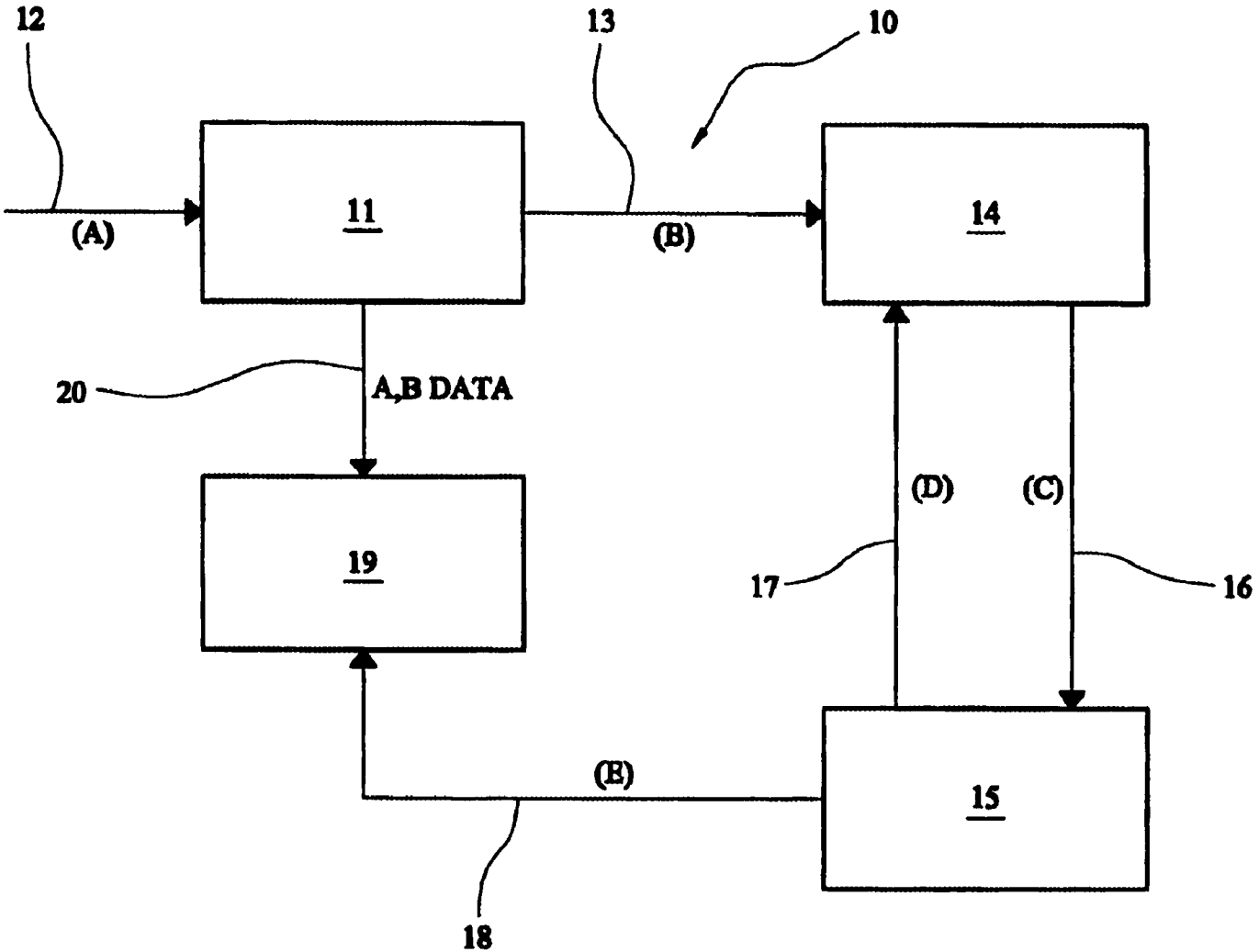
FIG. 1 is a schematic block diagram of a system for logging authorized detonator usage of coded detonators.

A preferred embodiment of a system according to the invention will now be described in detail, by way of example only, with reference to the accompanying block diagram.

Referring now to the drawing, there is disclosed in schematic form a system for logging authorised detonator usage of coded detonators, after removal of the detonators from a controlled store.

The system comprises means for maintaining an inventory of coded detonators at the controlled store, by maintaining data of coded detonators supplied to the store, and also data concerning authorised removal of detonators from the store for use on site as part of a controlled blasting sequence.

The system provides means for logging the issue of the signalling of the code of each detonator and its ready-to-fire status when sited at the blasting site. There is also provided means for monitoring and logging the destruction of each detonator after transmission of the fire signal to each detonator.

The system according to the invention is designated generally by reference 10, and which is shown in schematic form for the purposes of description and illustration only. A controlled store 11 of detonators is provided, and conveniently located in a secure and safe environment, and to which coded detonators supply 12 will be made, as shown by reference A. The secure and safe environment includes, but is not limited to, a site of manufacture and a blast site. Authorized removal of coded detonators, for use in a programmed blasting sequence, is shown by reference 13 and reference letter B, for use at a blasting site 14. The blasting site 14 will be a particular rock mass, and the detonators and associated explosive packages will be locate in bore holes arranged at predetermined positions throughout the rock mass.

The coded detonators are electronic detonators, which have unique detonator code data, and which is transmitted to firing control station 15 as detonator code data C via input line 16. Upon recognition of the detonator code data, the firing signal D is then transmitted via line 17 to the blasting site 14, so as to initiate a programmed blasting sequence.

The data transmitted along lines 16 and 17 is stored, and then transmitted via line 18 as data E via line 18 to the inventory control 19. In this manner, the event of the actual destruction of each blast detonator and a record of a number of blast detonators destroyed is preserved. The data may include serial numbers and time instants of destruction of the blast detonators. The time instant of destruction data of each detonator may include each detonator signaling code and ready-to-fire status.

The supply of detonators to the controlled store 11, and authorized removal, is inputted as data A and B to the inventory control via line 20.

The means by which the relevant data is transmitted to and from the various components of the system 1C is not critical, and any convenient means can be adopted, as will be evidenced to those of ordinary skill in the art. By way of example, bar code data information may be carried by the coded detonators, and which can be "read" by suitable handheld bar code readers.

The invention claimed is:

1. A system for logging authorized detonator usage of identifiable detonators, after removal of the detonators from a controlled store, and said system comprising:

an inventory control for maintaining inventory data comprising data relating to detonators supplied to the store and also data relating to authorized removal of blast detonators from the store for use at a blast site in a controlled blast;

a fire control station for identifying before the blast each blast detonator at the blast site, for transmitting a fire control signal to each blast detonator, and for logging detonator destruction data relating to destruction of blast detonators after transmission of the respective fire control signal; and data communication means between said fire control station and said inventory control for transmitting the detonator destruction data to the inventory control, for updating the inventory data after the blast.

2. A system according to claim 1, in which the controlled store is located at one of the blast site and a secure location.

3. A system according to claim 2, in which the controlled store is located at a site of manufacture.

4. A system according to claim 1, comprising means for data input of the data relating to detonators supplied to the store.

5. A system according to claim 4, comprising means for data input of the data relating to authorized removal of blast detonators from the store.

6. A system according to claim 5, in which the initiation of a fire control signal is transmitted after identification of each blast detonator.

7. A system according to claim 6, in which the fire control signal is transmitted after logging a code of a coded blast detonator and a ready-to-fire status.

8. A system according to claim 5, for preventing or detecting criminal access and use of detonators, by securely logging the event of the actual destruction of each blast detonator, and by preserving a record of a number of blast detonators destroyed.

9. A system according to claim 8, comprising means for storing data relating to serial numbers and time instants of destruction of the blast detonators.

10. A system according to claim 9, in which the time instant of destruction of each detonator is recorded by logging each detonator signalling a code, and ready-to fire status to the fire control station.

11. A system according to claim 10, in which an entry is made in a secure electronic register held in the fire control station of the event of the destruction of each detonator, following issue of the fire control signal.

12. A system according to claim 10, in which unauthorized removal of a blast detonator from the blast site aborts the fire control signal, resulting in no entry of destruction.

13. A system according to claim 8, in which removal of a blast detonator prior to transmission of the fire control signal results in a record being kept of only actual firing of detonators being logged, and thereby allowing recordal of any missing detonators.

14. A system according to claim 1, in which bar codes are utilized on the detonators, to be logged at the time of authorized removal of the detonators.

15. A system according to claim 14, in which the logging is carried out by a hand held bar code reader, which is then subsequently securely logged electronically with a use log at the fire control station.

16. A system according to claim 15, in which the data in the use log is downloadable and comparable in the hand held bar code reader, to verify detonator use.

17. A system according to claim 1, in which the blast detonators are resistive electrical detonators.

18. A system according to claim 17, including means for signalling data of each detonator status and which data is available at the time at which the detonator is required to fire.

19. A system according to claim 18, comprising means for identifying the blast detonators comprising one of individual detonator codes and sequential wiring of the blast detonators.

20. A system according to claim 1, in which the identifiable detonators are coded at a factory of manufacture.

21. A system according to claim 1, wherein the blast detonators are interconnected at the blast site by a wired system.

22. A method for logging authorized detonator usage of identifiable detonators in a controlled store and comprising:

maintaining inventory data in an inventory control of detonators supplied to the store, and also maintaining data relating to authorized removal of blast detonators from the store for use at a blast site in a controlled blast;

identifying at a fire control station and before the blast each blast detonator at the blast site;

transmitting a fire control signal from the fire control station to each detonator, and monitoring and logging detonator destruction data relating to destruction of detonators after transmission of the respective fire control signal; and communicating the detonator destruction data from the fire control station to the inventory control, to update the inventory data after the blast.

* * * * *